US006043488A

United States Patent [19]

Bahatt et al.

[11] Patent Number: 6,043,488

[45] **Date of Patent: *Mar. 28, 2000**

[54] CARRIER GAS SEPARATOR FOR MASS SPECTROSCOPY

[75] Inventors: Dar Bahatt, Stamford; David G. Welkie, Trumbull, both of Conn.

[73] Assignee: The Perkin-Elmer Corporation, Norwalk, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/914,386

[22] Filed: Aug. 18, 1997

[51] Int. Cl.[7] ..... H01J 49/30

[52] U.S. Cl. ..... 250/294; 250/298; 250/288; 250/396 ML

[58] Field of Search ..... 250/294, 298, 250/281, 288, 396 ML

[56] References Cited

U.S. PATENT DOCUMENTS

| | | | |
|---|---|---|---|
| 3,641,339 | 2/1972 | McCormick | 250/298 |
| 4,047,030 | 9/1977 | Lobach | 250/281 |
| 4,174,479 | 11/1979 | Tuithof et al. | 250/292 |
| 4,480,187 | 10/1984 | Matsuda | 250/296 |
| 4,727,249 | 2/1988 | Bateman et al. | 250/299 |

*Primary Examiner*—Jack I. Berman
*Attorney, Agent, or Firm*—Joseph V. Gamberdell, Jr.; David Aker

[57] ABSTRACT

A system for separating certain ions from an ion beam in a mass spectrometer. A magnetic or electrostatic field is applied at an angle to the ion beam, causing the ions to disperse according to their mass to charge ratio. The ions are dispersed enough to allow certain ions to be blocked and removed from the beam using a physical stop. A subsequent plurality of fields is then applied to reform the beam and adjust its direction and dispersion.

18 Claims, 6 Drawing Sheets

CARRIER GAS SEPARATOR FOR MASS SPECTROSCOPY

FIELD OF THE INVENTION

This invention generally relates to a mass spectrometer with an ion source, where the ion source is producing an ion beam containing both carrier ions and analyte ions. This invention specifically comprises a separation system for removing the carrier ions from the ion beam.

BACKGROUND OF THE INVENTION

In a gas chromatography-mass spectroscopy (GC-MS) instrument, gas chromatography is usually performed first and the resulting gas stream is then introduced into the mass spectrometer. As a result, both the carrier gas used during gas chromatography and the analytes become ionized and are directed as an ion beam into the mass spectrometer detector. While the ionization cross section for the carrier gas is typically more than ten times less than those of the analyte ions of interest, the carrier concentration is orders of magnitude greater than the analytes. As a result, the carrier ion concentration in the ion beam is many times more intense than the analyte ions.

One adverse consequence of this is that the electrostatic space charge effects due to the intense carrier ion concentration cause the ion beam to diverge. The divergence can be determined by the equation:

$$\frac{Z}{r_0} = \frac{0.75V^{3/4}}{I^{1/2}} \qquad \text{Equation 1}$$

Where

Z is the distance in which the beam diameter will double $r_o$ is the initial radius of the beam I is the beam current V is the beam potential The divergent beam may cause signal loss during detection if some of the beam falls outside the detector entrance. Another adverse consequence of the high carrier ion concentration is detector distortion or saturation. If the concentration causes the detector to exceed its linear range, its output will be distorted and the system may report erroneous results. In the event that the detector becomes saturated, those erroneous results will continue until the detector overcomes any inherent hysteresis.

One solution has been to gate the detector off during the arrival of the carrier ions, but this has the disadvantage of burdening the system with additional circuitry. Another solution has been to include an electrostatic deflection gate in the flight region that is activated during the passage of carrier ions, thereby preventing them from reaching the detector. This solution requires additional circuitry, additional mechanisms, precise timing and critical placement in the flight region.

SUMMARY OF THE INVENTION

The present invention is based on the realization that it would be more advantageous to remove the carrier ions from the beam as soon as possible after the ion source, in order to prevent space charge effects and to minimize detector saturation problems. It is the object of this invention to provide for the removal of carrier ions from the ion beam after the ion source but before entering the mass spectroscopy detector. In accordance with the invention this is achieved by applying a magnetic or electrostatic field to the ion beam soon after it emerges from the ion source which causes the constituents of the ion beam to disperse according to their mass to charge ratios. Because the amount of dispersion is related to the individual ion's mass charge ratio and the strength of the applied magnetic or electrostatic field, the location of ions in the plane perpendicular to the ion stream can be accurately predicted. A mechanical stop can then be placed to block ions from the stream as desired.

DETAILED DESCRIPTION OF THE INVENTION

Figure 1:
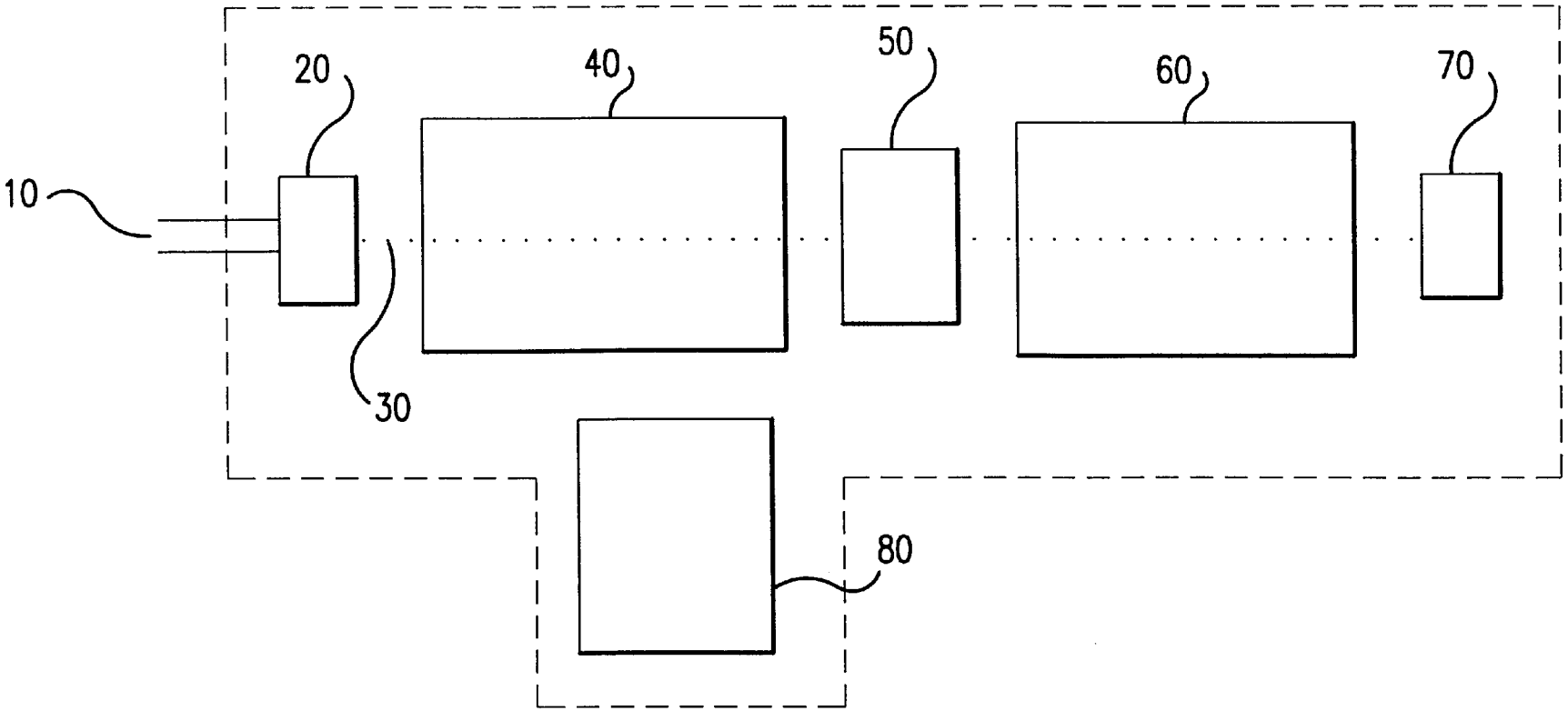
FIG. 1 shows a schematic of a mass spectrometer

FIG. 1 shows a schematic of a mass spectrometer utilizing the invention. Carrier gas containing analytes is introduced into the mass spectrometer through a sample inlet 10. From there it travels into the ion source 20 where the gas stream is ionized. The resulting ion stream 30 may be subjected to optionally either electrostatic or magnetic fields in a first region 40. The ion stream then passes through a separator 50 in accordance with the present invention and specific ions are blocked from the stream. The ion stream may again be optionally subjected to additional electrostatic or magnetic fields in a second region 60 and is then directed into a mass analyzer 70. A typical mass analyzer might consist of a quadrapole, ion trap, or time of flight system including a detector. A vacuum system 80 keeps the main components of the mass spectrometer at negative pressure.

Figure 2:
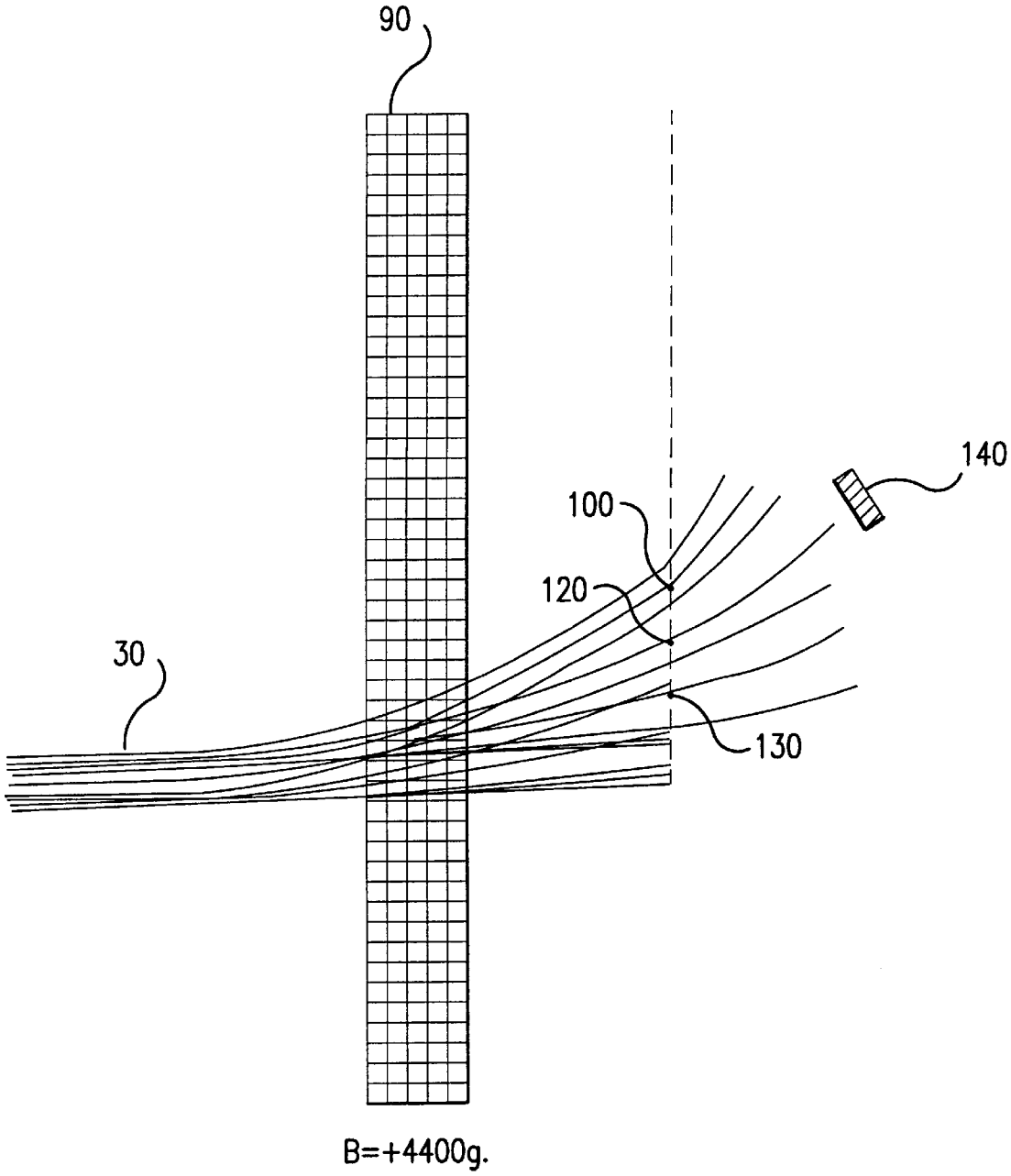
FIG. 2 shows a detailed view of the effects of the first magnetic field

FIG. 2 shows a diagram of the first field according to the invention, in this embodiment a magnetic field. In FIG. 2 the ion stream 30 is previously accelerated and collimated so that the ions are brought to a homogeneous energy of 300 eV and the stream is approximately 1 mm wide. In a GC-MS instrument the carrier gas might be helium, hydrogen or nitrogen or any other typical GC carrier gas. The beam is then subjected to a first magnetic field 90 approximately 6 mm long along its axis of travel, having a strength and polarity of +4400 gauss, applied perpendicular to the beam. Within the magnetic field the ions disperse, following circular paths defined by the following equation:

$$r = \left(\frac{144}{B}\right)\left(\sqrt{mV}\right) \qquad \text{Equation 2}$$

Where r=the radius of the path

B=the magnetic field strength in gauss m=the mass of a particular ion in atomic mass units V=the potential of the particular ion After passing through the magnetic field, the ions continue to disperse, traveling tangentially to their previous circular paths. A particular ion's total perpendicular deflection $x_t$, from the ion beam at a particular distance from the beginning of the magnetic field is determined by the equation:

$$x_t = \frac{lL}{\sqrt{r^2 - l^2}} + r\left(1 - \sqrt{1 - \left(\frac{l}{r}\right)^2}\right) \quad \text{Equation 3}$$

Where $x_t$ is the total distance the ion is deflected from the beam l is the length of the magnetic field, L is the length the ion has traveled along the ion beam's axis of travel after the magnetic field, and r is the radius of the path from Equation 2

While traveling through the magnetic field, helium ions in the stream with a mass of 4 follow a path having a 29 mm radius, hydrogen ions with a mass of 2 follow a 20 mm radius and nitrogen ions with a mass of 28 follow a 76 mm radius. Using a magnetic field width of 6 mm, at approximately 25 mm past the magnetic field, helium diverges approximately 6.5 mm to follow path 100 from the beam, hydrogen approximately 9.3 mm to follow path 120 and nitrogen approximately 2.4 mm to follow path 130. A physical stop 140 is constructed and placed to block particular ions and remove them from the stream. Preferably the stop is positioned anywhere along the beam as long as the beam has diverged enough so the stop blocks those particular ions and effectively removes them from the stream.

Figure 3:
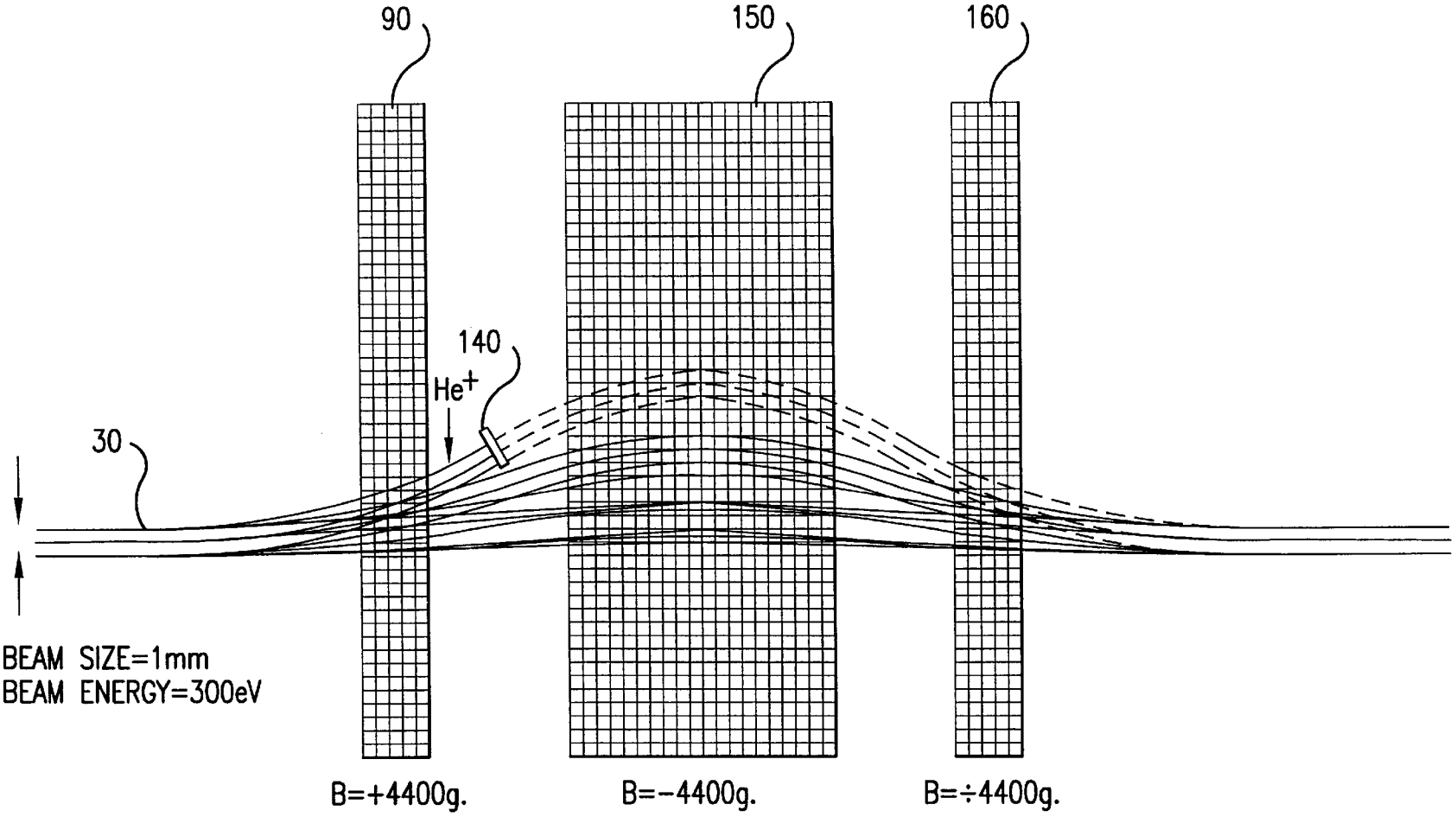
FIG. 3 shows one embodiment of the invention using three magnetic fields.

FIG. 3 shows an embodiment where a second magnetic field 150 of equal magnitude, reverse polarity and double the length of magnetic field 90 in the direction of ion travel is then applied to the stream causing it to reconverge. The stream is then subjected to a third magnetic field 160 having the same magnitude and polarity as the first, in order to re-collimate and direct the beam.

Figure 4:
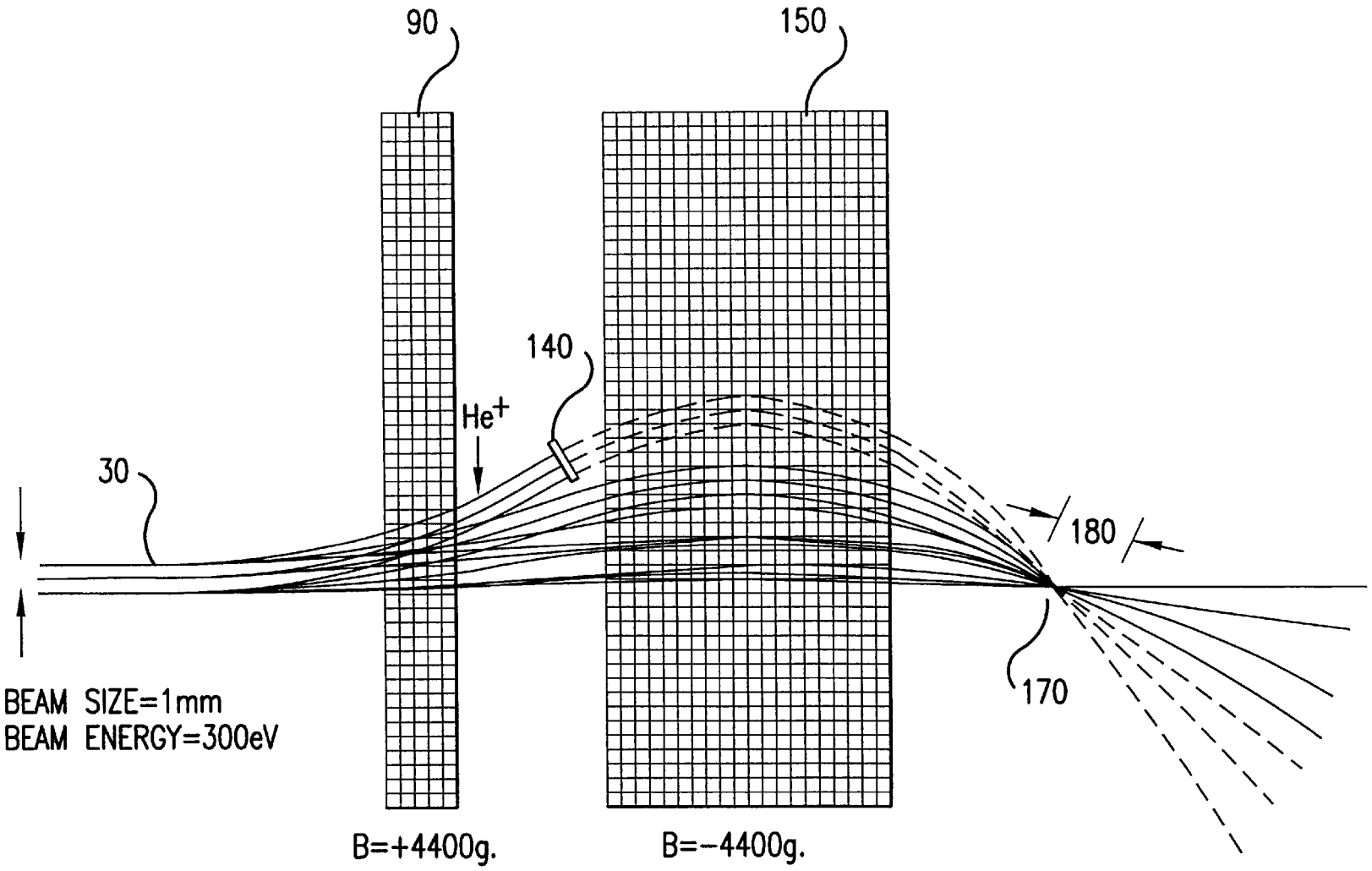
FIG. 4 shows a second embodiment of the invention using two magnetic fields.

FIG. 4 shows an embodiment using two magnetic fields of opposite polarity. The ion stream 30 is accelerated and collimated so that the ions are brought to a homogeneous potential of 300 eV and the stream is approximately 1 mm wide. The first magnetic field 90 is applied, causing the ions to disperse according to Equation 2. The physical stop 140 is positioned to block the ions of interest and subsequently a second magnetic field 150 is applied, causing the beam to reconverge. Because there is no third magnetic field, the beam will converge in an area 170 and then begin to disperse, however, the detector can be located effectively in the region 180 around the convergence point where the beam is condensed enough to meet detection requirements.

The actual strengths and lengths of the magnetic fields in the embodiments of FIGS. 2, 3 and 4 may vary according to the dispersion and reconvergence required in order to achieve acceptable detection and the available area in which to achieve separation. The angle at which the magnetic fields are applied with respect to the direction of the ion stream and the beam energy also may vary depending on the desired location of the stop.

Electrostatic fields may be used with similar results. Before application of an electrostatic separation arrangement, the ion stream is accelerated so that the ions have a homogeneous velocity as opposed to potential. Within an electrostatic field applied perpendicular to the ion stream's direction of travel, a particular ion follows a parabolic path defined by the equation:

$$x = \tfrac{1}{2}\, a_x t^2 \quad \text{Equation 4}$$

Where x is the distance the ion is deflected from the beam, $a_x$ is the acceleration of the ion in the direction of the field, and t is the time the ion is present in the field The acceleration is further defined as $qE_x/m$, where q is the ion's charge, $E_x$ is the strength of the electrostatic field and m is the mass of the ion. The time the ion is present in the field is further defined as l/v, where l is the length of the field and v is the initial velocity of the ion along the beam's direction of travel. Substituting these values into Equation 4 yields:

$$x = \tfrac{1}{2}\,(qE_x/m)(l/v)^2 \quad \text{Equation 5}$$

After passing through the electrostatic field, the ion continues to deflect from the beam, traveling tangentially to its previous parabolic path. The deflection outside the field, $x_0$ is defined by:

$$x_0 - L(\tan A) \quad \text{Equation 6}$$

where

L is the length the ion has traveled along the ion beam's axis of travel after the magnetic field, and A is the angle of deflection from the beam outside the field The tangent of the angle of deflection outside the field is determined by $v_x/v$ where $v_x$ is the velocity attained by the ion in the direction of the electrostatic field and v is the initial velocity in the direction of travel. The velocity attained by the ion in the direction of the electrostatic field is further defined as $v_x = v_{ix} + a_x t$ where $v_{ix}$ is the initial velocity in the direction of the field, $a_x$ is the acceleration of the ion in the direction of the field and t is the time the ion is present in the field. Assuming the initial velocity in the direction of the field is zero (0) and using the denotation of acceleration from Equation 5 above the tangent of A becomes $(qE_x l)/(mv_y^2)$. The total deflection from the beginning of the electrostatic field is defined by:

$$x_t = x + x_0 \quad \text{Equation 7}$$

or $$x_t = \tfrac{1}{2}\,(qE_x/m)(l/v)^2 + L(qE_x l)/(mv^2) \quad \text{Equation 8}$$

Figure 5:
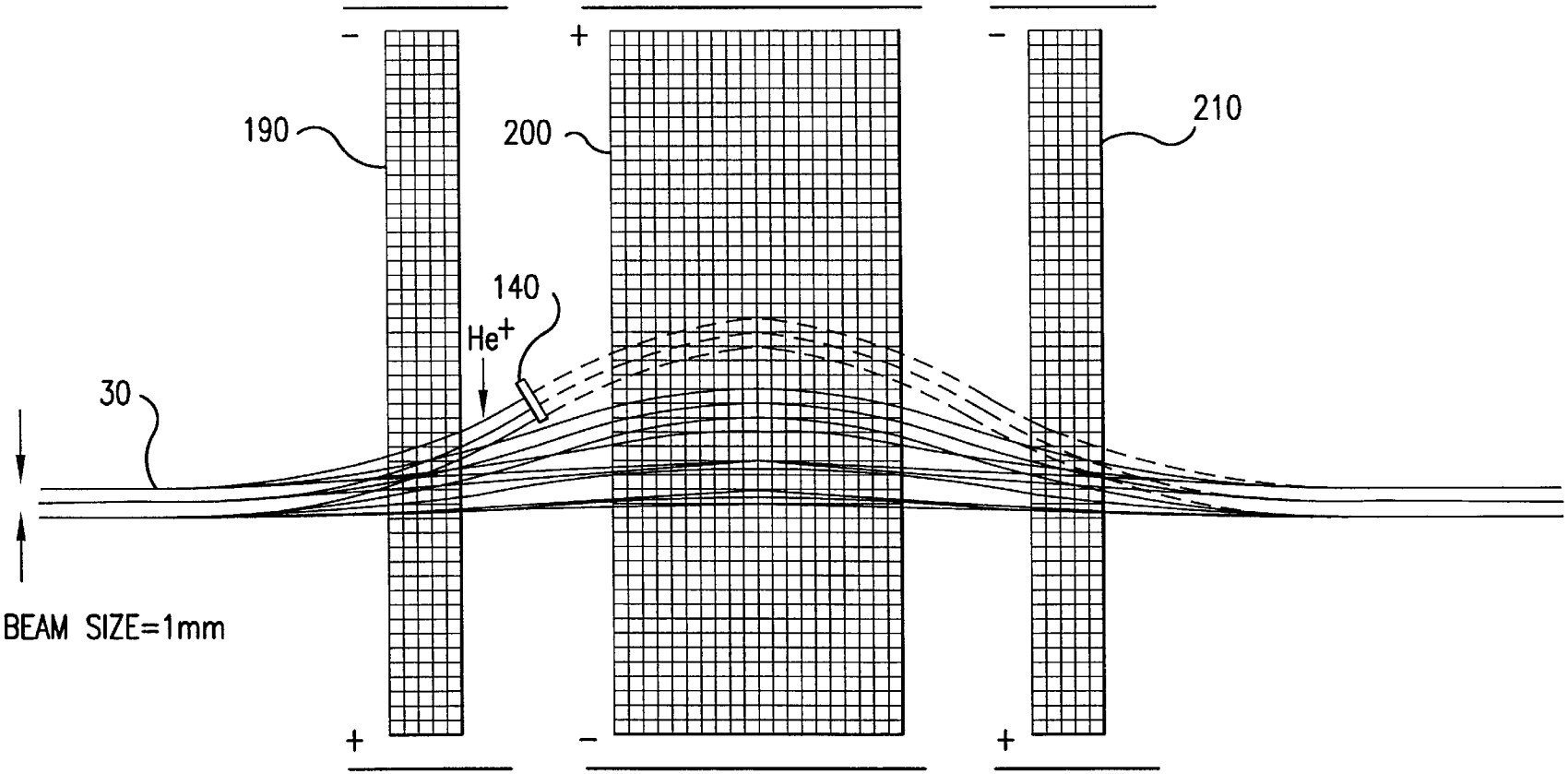
FIG. 5 shows a third embodiment of the invention using three electrostatic fields.

FIG. 5 shows an embodiment where three electrostatic fields are applied to the stream. In FIG. 5 the ion stream 30 is previously accelerated and collimated so that the ions are brought to a homogeneous velocity and the stream is approximately 1 mm wide. The beam is then subjected to a first electrostatic field 190 along its axis of travel, applied perpendicular to the beam.

Calculations similar to those performed for the magnetic field example above are performed using equation 8 to determine the deflection for specific ions and the ideal location for the stop. The physical stop 140 is constructed and placed to block particular ions and remove them from the stream. As stated previously, the stop is positioned anywhere along the beam as long as the beam has diverged enough so the stop blocks those particular ions and effectively removes them from the stream.

Figure 6:
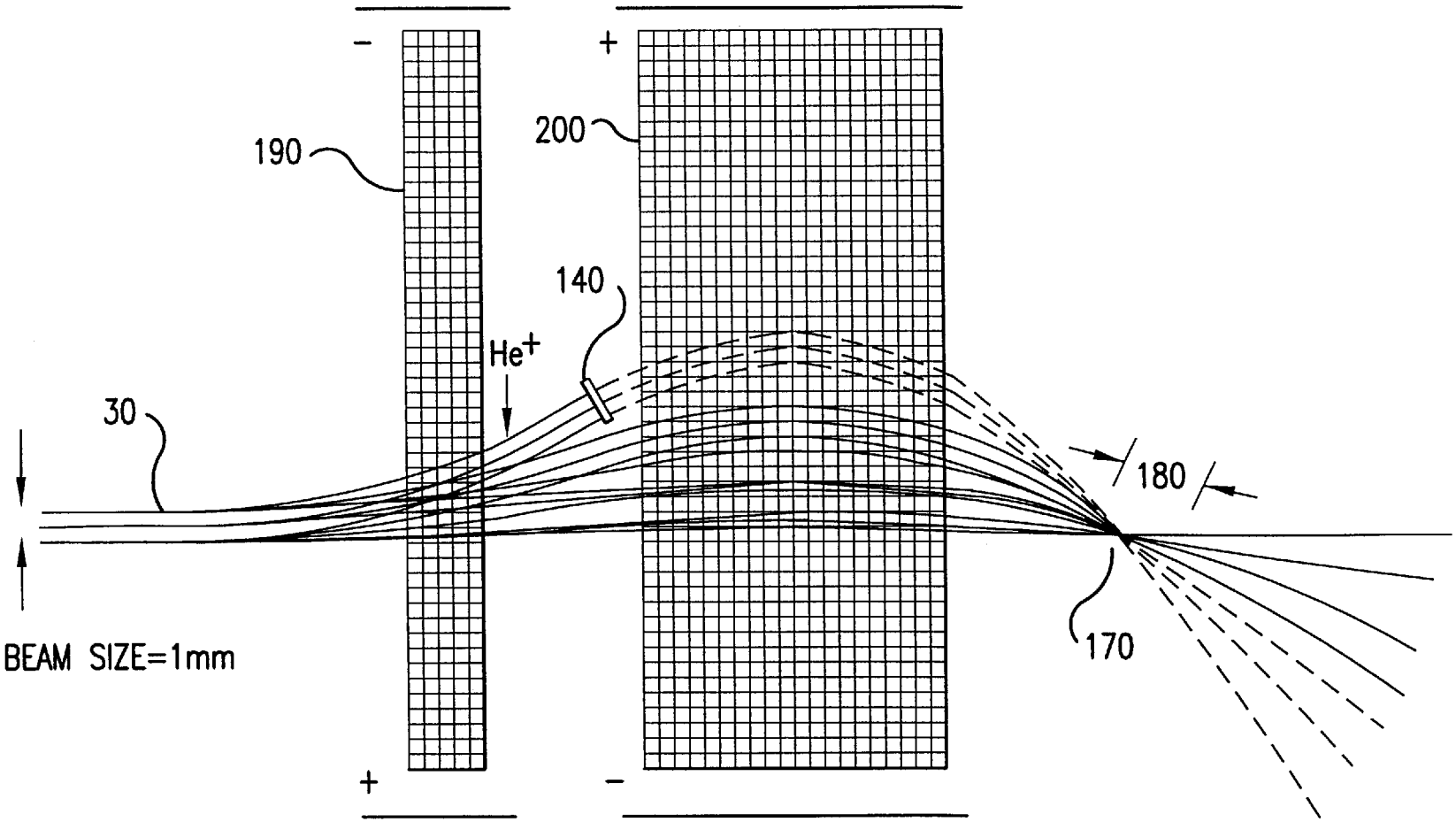
FIG. 6 shows a fourth embodiment of the invention using two electrostatic fields.

A second electrostatic field 200 of equal magnitude, reverse polarity and double the length of electrostatic field 190 in the direction of ion travel is then applied to the stream causing it to reconverge. The stream is then subjected to a third electrostatic field 210 having the same magnitude and polarity as the first, in order to re-collimate and direct the beam. FIG. 6 shows an embodiment using only two electrostatic fields of opposite polarity. The ion stream 30 is accelerated and collimated so that the ions are brought to a homogeneous velocity and the stream is approximately 1 mm wide. The first electrostatic field 190 is applied, causing the ions to disperse according to Equation 8. The physical stop 140 is positioned to block the ions of interest and subsequently a second electrostatic field 150 is applied, causing the beam to reconverge. Because there is no third electrostatic field, the beam will converge in an area 170 and then begin to disperse, however, the detector can be located effectively in the region 180 around the convergence point where the beam is condensed enough to meet detection requirements. As with the magnetic fields embodiment, the actual strengths and lengths of the electrostatic fields in the embodiments of FIGS. 5 and 6 may vary according to the dispersion and reconvergence required in order to achieve acceptable detection and the available area in which to achieve separation. The angle at which the electrostatic fields are applied with respect to the direction of the ion stream and the beam energy also may vary depending on the desired location of the stop.

We claim:

1. A method of separating ions from an ion beam comprising:

causing all ions in said beam to be brought to a homogeneous energy;

applying a first magnetic field at an angle to said ion beam, causing said ions to disperse according to their mass to charge ratios;

blocking dispersed ions having a particular range of mass to charge ratios;

applying a second magnetic field and a third magnetic field to said ion beam to reverse the effects of said first magnetic field and to direct and collimate said ion beam.

2. The method of claim 1 where said ion beam comprises carrier ions and analyte ions and said blocked ions are carrier ions.

3. The method of claim 1 where said blocked ions are removed from said ion beam.

4. The method of claim 1 as utilized in a mass spectrometer having an ion source.

5. An apparatus for separating ions from an ion beam comprising:

means for causing all ions in said beam to be brought to a homogeneous energy;

a first magnetic field means positioned so as to apply a first field at an angle to said ion beam causing said ions to disperse according to their mass charge ratios;

a mechanical stop located along said ion beam for blocking dispersed ions having a particular range of mass to charge ratios;

a second magnetic field means positioned so as to apply a second field to said ion beam and a third magnetic field means positioned so as to apply a third magnetic field to said ion beam to reverse the effects of said first magnetic field means upon said ion beam and to direct and collimate said ion beam.

6. The apparatus of claim 5 where said ion beam comprises carrier ions and analyte ions and said blocked ions are carrier ions.

7. The apparatus of claim 5 where said blocked ions are removed from said ion beam.

8. The apparatus of claim 5 as utilized in a mass spectrometer having an ion source.

9. A mass spectrometer having a sample inlet, an ion source, an ion mass analyzer and a vacuum system in combination with the apparatus of claim 5.

10. A method of separating ions from an ion beam comprising:

causing all ions in said beam to be brought to a homogeneous energy;

applying a first magnetic field at an angle to said ion beam, causing said ions to disperse according to their mass to charge ratios;

blocking dispersed ions having a particular range of mass to charge ratios;

applying a second magnetic field to said ion beam to cause a reconvergence of and to direct said ion beam.

11. The method of claim 10 where said ion beam comprises carrier ions and analyte ions and said blocked ions are carrier ions.

12. The method of claim 10 where said blocked ions are removed from said ion beam.

13. The method of claim 10 as utilized in a mass spectrometer having an ion source.

14. An apparatus for separating ions from an ion beam comprising:

means for causing all ions in said beam to be brought to a homogeneous energy;

a first magnetic field means positioned so as to apply a first field at an angle to said ion beam causing said ions to disperse according to their mass charge ratios;

a mechanical stop located along said ion beam for blocking dispersed ions having a particular range of mass to charge ratios;

a second magnetic field means positioned so as to apply a second field to said ion beam to cause a reconvergence of and to direct said ion beam.

15. The apparatus of claim 14 where said ion beam comprises carrier ions and analyte ions and said blocked ions are carrier ions.

16. The apparatus of claim 14 where said blocked ions are removed from said ion beam.

17. The apparatus of claim 14 as utilized in a mass spectrometer having an ion source.

18. A mass spectrometer having a sample inlet, an ion source, an ion mass analyzer and a vacuum system in combination with the apparatus of claim 14.

* * * * *